US009022641B2

(12) United States Patent
Nomura et al.

(10) Patent No.: US 9,022,641 B2
(45) Date of Patent: May 5, 2015

(54) FLUID AGITATION APPARATUS FOR REDUCING TEMPERATURE FLUCTUATION AND THERMOSTATIC APPARATUS

(71) Applicant: Canon Kabushiki Kaisha, Tokyo (JP)

(72) Inventors: Masaki Nomura, Yokohama (JP); Masashi Nakatsugawa, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 122 days.

(21) Appl. No.: 13/685,854

(22) Filed: Nov. 27, 2012

(65) Prior Publication Data

US 2013/0142008 A1 Jun. 6, 2013

(30) Foreign Application Priority Data

Dec. 6, 2011 (JP) ..... 2011-267064

(51) Int. Cl.

| | |
|---|---|
| ***B01F 5/00*** | (2006.01) |
| ***B01F 7/00*** | (2006.01) |
| ***B01F 5/06*** | (2006.01) |
| ***B01F 3/02*** | (2006.01) |

(52) U.S. Cl.

CPC ..... *B01F 7/00008* (2013.01); *B01F 5/0641* (2013.01); *B01F 5/0652* (2013.01); *B01F 3/02* (2013.01); *B01F 2005/0017* (2013.01); *B01F 2215/0431* (2013.01); *B01F 2215/045* (2013.01); *B01F 2215/0472* (2013.01)

(58) Field of Classification Search

CPC ..... B01F 5/0641; B01F 5/0652
USPC ..... 366/337–338, 165.2
See application file for complete search history.

(56) References Cited

U.S. PATENT DOCUMENTS

| | | | | |
|---|---|---|---|---|
| 5,145,256 | A * | 9/1992 | Wiemers et al. | 366/336 |
| 7,954,514 | B2 * | 6/2011 | Tung et al. | 138/37 |
| 8,147,124 | B1 * | 4/2012 | Glanville | 366/338 |
| 8,322,381 | B1 * | 12/2012 | Glanville et al. | 138/39 |

FOREIGN PATENT DOCUMENTS

JP 58-177126 A 10/1983

* cited by examiner

*Primary Examiner* — David Sorkin
*Assistant Examiner* — Abbas Rashid
(74) *Attorney, Agent, or Firm* — Fitzpatrick, Cella, Harper & Scinto

(57) ABSTRACT

Provided are a fluid agitation apparatus using a structure which is simple in shape and short in a fluid passage direction without a movable part so as to produce a sufficient effect from the viewpoint of reducing temperature fluctuation, and a thermostatic apparatus using the fluid agitation apparatus. The fluid agitation apparatus is installed in a fluid passage and includes, in an order from an upstream side thereof: a dividing part for dividing a flow of a fluid into a plurality of flows; a circumvolving part for circumvolving the fluid about an axis in a flow direction of the fluid; and an accelerating part for increasing a flow rate of the fluid.

5 Claims, 4 Drawing Sheets

FLUID AGITATION APPARATUS FOR REDUCING TEMPERATURE FLUCTUATION AND THERMOSTATIC APPARATUS

BACKGROUND OF THE INVENTION

1. Field of the Invention

The present invention relates to a fluid agitation apparatus for reducing temperature fluctuation, and a thermostatic apparatus using the fluid agitation apparatus.

2. Description of the Related Art

In recent years, there has been required nanometer-order positioning and processing accuracy for semiconductor exposure apparatuses and ultra-precision machining apparatuses, and along with this, there has been required temperature stability of the apparatus at a tolerance of ±0.001° C.

In order to stabilize the temperature of the apparatus at a constant temperature, a thermostatic chamber is generally prepared to circulate air controlled at a constant temperature. However, even when the temperature of the gas (for example, air) introduced into the thermostatic chamber fluctuates, the temperature of the thermostatic chamber fluctuates, which may reduce the temperature stability of the apparatus.

In order to reduce such temperature fluctuation, there has been proposed a fluid agitation apparatus capable of reducing temperature fluctuation of a fluid in a cross section on a downstream side of a fluid passage. Examples of the conventional fluid agitation apparatus include a fluid agitation apparatus for agitating a fluid through use of a movable member such as a propeller, and as exemplified in FIG. 3, a fluid agitation apparatus for agitating a fluid by generating a circumvolving flow in the fluid through use of a fluid passage which is processed into a spiral shape (see, for example, Japanese Patent Application Laid-Open No. 58-177126).

In the conventional fluid agitation apparatus using the movable member as described above, there has been a problem that the temperature may still fluctuate due to heat generated in a sliding portion of the movable member. Further, in the conventional fluid agitation apparatus using the fluid passage processed into a spiral shape as exemplified in FIG. 3, there have been problems that the shaping process and the like become complicated, and a given length is required in the fluid passage direction so as to obtain a sufficient effect of reducing temperature fluctuation.

SUMMARY OF THE INVENTION

It is an object of the present invention to attain a fluid agitation apparatus using a structure which is simple in shape and short in a fluid passage direction without a movable part so as to produce a sufficient effect from the viewpoint of reducing temperature fluctuation, and to propose a thermostatic apparatus capable of reducing temperature fluctuation thereof.

According to an exemplary embodiment of the present invention, there is provided a fluid agitation apparatus for reducing temperature fluctuation, including, in an order from an upstream side thereof: a dividing part for dividing a flow of a fluid into a plurality of flows; a circumvolving part for circumvolving the fluid about an axis in a flow direction of the fluid; and an accelerating part for increasing a flow rate of the fluid.

According to an exemplary embodiment of the present invention, there is provided a thermostatic apparatus, including the above-mentioned fluid agitation apparatus for reducing temperature fluctuation.

According to the present invention, the fluid is divided into a plurality of flows by the dividing part, and the plurality of flows are mixed again by generating circumvolving flows about the axis in the flow direction during a period in which the flows pass through the circumvolving part. The mixed circumvolving flows are accelerated by the accelerating part into stronger circumvolving flows so that the fluid is sufficiently agitated. As a result, the temperature fluctuation of the fluid can be reduced and therefore the temperature fluctuation in the thermostatic chamber can be suppressed.

Further features of the present invention will become apparent from the following description of exemplary embodiments with reference to the attached drawings.

BRIEF DESCRIPTION OF THE DRAWINGS

FIG. 1A is a perspective view of the fluid agitation apparatus as seen from an upstream side of a fluid passage. FIG. 1B is a perspective view of the fluid agitation apparatus as seen from a downstream side of the fluid passage. FIG. 1C is a side view of the fluid agitation apparatus. FIG. 1D is a sectional view taken along the line 1D-1D in FIG. 1C.

FIG. 2A is a perspective view of the fluid agitation apparatus as seen from the upstream side of the fluid passage. FIG. 2B is a perspective view of the fluid agitation apparatus as seen from the downstream side of the fluid passage. FIG. 2C is a side view of the fluid agitation apparatus. FIG. 2D is a sectional view taken along the line 2D-2D in FIG. 2C.

DESCRIPTION OF THE EMBODIMENTS

A fluid agitation apparatus for reducing temperature fluctuation according to the present invention includes, in an order from an upstream side thereof, a dividing part for dividing a flow of a fluid into a plurality of flows, a circumvolving part for circumvolving the fluid about an axis in a flow direction of the fluid, and an accelerating part for increasing a flow rate of the fluid. Accordingly, it is possible to attain a fluid agitation apparatus which provides a sufficient effect from the viewpoint of reducing temperature fluctuation.

In the following, with reference to the attached drawings, exemplary embodiments of the present invention are described in more detail by way of examples. However, the present invention is not limited to the following embodiments.

(First Embodiment)

Figure 1A:
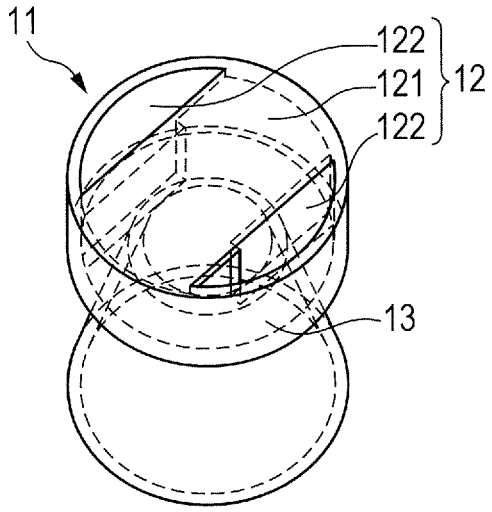
FIGS. 1A, 1B, 1C, and 1D are views illustrating a fluid agitation apparatus according to a first embodiment of the present invention. Specifically.
Figure 1B:
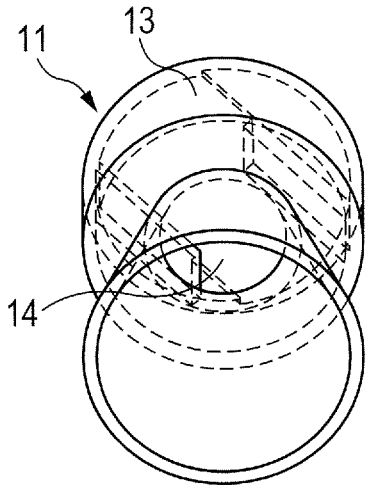
Figure 1C:
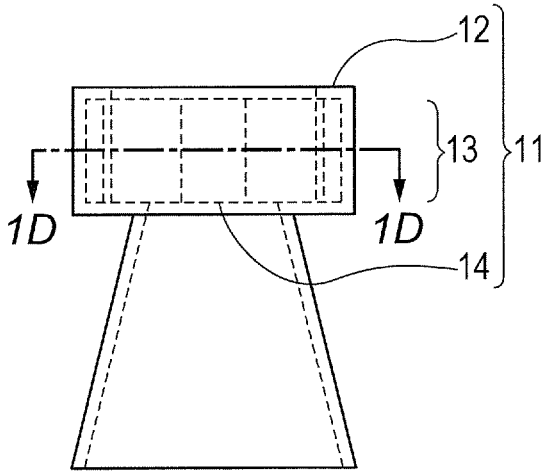
Figure 1D:
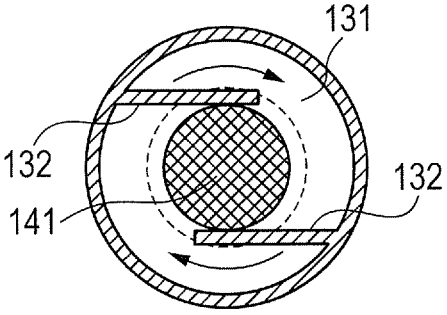

FIGS. 1A, 1B, 1C, and 1D are views illustrating a fluid agitation apparatus according to a first embodiment of the present invention, which is configured to agitate a fluid passing through a fluid passage to reduce temperature fluctuation of the fluid in a cross section on a downstream side of the fluid passage. Specifically, FIG. 1A is a perspective view of the fluid agitation apparatus as seen from an upstream side of the fluid passage. FIG. 1B is a perspective view of the fluid agitation apparatus as seen from a downstream side of the fluid passage. FIG. 1C is a side view of the fluid agitation apparatus. FIG. 1D is a sectional view taken along the line 1D-1D of FIG. 1C. Incidentally, the broken lines of FIGS. 1A, 1B, 1C, and 1D are hidden lines, and the portion indicated by hatched lines in the sectional view shows a cross section, while the portion indicated by cross-hatched lines shows the shape of an opening plane of the accelerating part. The term "opening plane" as herein employed refers to an imaginary plane connecting edges of the opening. As is apparent from FIGS. 1A, 1B, 1C, and 1D, the fluid agitation apparatus of this embodiment is formed into a simple shape including a flat surface, a cylindrical surface, a tapered surface, and the like.

A fluid agitation apparatus 11 for reducing temperature fluctuation according to the first embodiment is installed in the fluid passage with its dividing part 12 side set as the upstream side. The dividing part 12 is closed by a closing surface 121 at a part in the vicinity of a center of the fluid passage, and hence the fluid in the fluid passage cannot pass through this region, but instead passes through a region of arcuate opening planes 122 provided at two opposing locations in the vicinity of an outer periphery of the fluid passage.

A circumvolving part 13 connects the dividing part 12 and an accelerating part 14 to each other. As indicated by the cross hatching of FIG. 1D, the fluid passage in the accelerating part 14 is shaped as an opening plane 141 provided only in the vicinity of the center of the fluid passage, and hence the vicinity of an outer periphery at a downstream end of the circumvolving part 13, which includes positions substantially opposed to the opening planes 122 of the dividing part 12, is closed by a closing surface 131. With this structure, the fluid passing through the opening planes 122 in the vicinity of the outer periphery of the dividing part 12 flows straight in the circumvolving part 13, and then changes the flow direction to a direction substantially orthogonal to the fluid passage direction at a position in the vicinity of the downstream end of the circumvolving part 13.

In this embodiment, in order to generate circumvolving flows more effectively in the circumvolving part 13, stationary surfaces 132 having a rectangular plate shape are arranged in the fluid passage of the circumvolving part 13 in a direction parallel to the fluid passage direction. One end of each stationary surface 132 is held in contact with an inner peripheral wall of the circumvolving part 13 so that the circumvolving flow is generated only in one direction (direction indicated by the arrow in FIG. 1D) when the fluid changes its flow direction.

The circumvolving flows generated by the mechanism as described above are accelerated into stronger circumvolving flows by passing through the opening plane 141 of the accelerating part 14, which has an area smaller than a sectional area of the circumvolving part 13 in a direction perpendicular to the fluid passage direction.

In this embodiment, the cross sections of the opening plane 141 of the accelerating part 14 and the fluid passage continuous with the downstream side thereof are formed into a circular shape. Therefore, the circumvolving flows are formed into a spiral shape, and fluid stagnation points are not easily generated on the downstream side of the accelerating part 14. Accordingly, the fluid is sufficiently agitated, with the result that the temperature fluctuation of the fluid can be reduced.

(Example)

A numerical analysis was conducted to compare an effect of reducing temperature fluctuation of the fluid according to this embodiment with an effect of reducing temperature fluctuation of the fluid according to an example of a conventional fluid agitation apparatus. In the following, conditions and results of the analysis are described.

Figure 3:
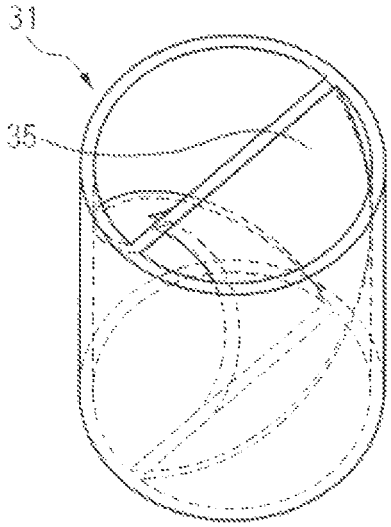
FIG. 3 PRIOR ART
FIG. 3 is a perspective view illustrating an example of a conventional fluid agitation apparatus.
Figure 4:
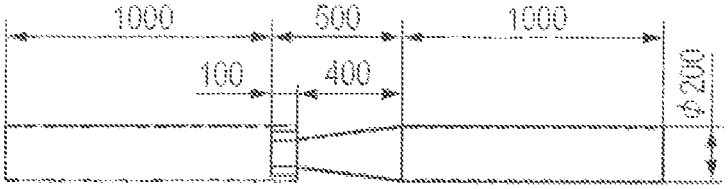
FIG. 4 is a view illustrating a numerical analysis model of the fluid agitation apparatus according to an example of the present invention.
Figure 5:
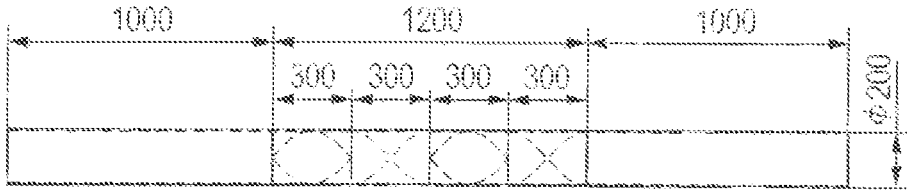
FIG. 5 PRIOR ART
FIG. 5 is a view illustrating a numerical analysis model of the conventional fluid agitation apparatus.

FIG. 4 is a view illustrating an analysis model obtained when the effect of reducing temperature fluctuation of the fluid according to an example of the present invention was estimated through the numerical analysis. FIG. 5 is a view illustrating an analysis model obtained when the effect of reducing temperature fluctuation of the fluid according to the example of the conventional fluid agitation apparatus was estimated through the numerical analysis. In the analysis model of FIG. 5, a conventional fluid agitation apparatus 31 illustrated in FIG. 3 is used. Spiral-shaped parts 35 which revolve in opposite directions are arranged alternately, and spiral-shaped ends thereof are coupled orthogonally to each other.

In the numerical analysis conducted in this case, it is assumed that the fluid flows from the left to the right in FIGS. 4 and 5. At the position of the left end surface of FIGS. 4 and 5 serving as a temperature fluctuation imparting surface, the temperature fluctuation was imparted to the fluid, and then a predetermined fluid was caused to flow at a predetermined flow rate. After passing through the fluid agitation apparatus, the fluid reached the right end surface of FIGS. 4 and 5 serving as a temperature fluctuation evaluation surface, and the effects of reducing temperature fluctuation of the respective fluid agitation apparatus were evaluated based on a standard deviation value of the temperature fluctuation of the fluid at the position of that surface.

As can be seen from FIGS. 4 and 5, the following shapes and dimensions are common between the example of the present invention and the example of the conventional fluid agitation apparatus. In the both examples, the fluid passage has a circular shape at a diameter of 200 mm. In the both examples, the distance from the left end surface of FIGS. 4 and 5 serving as the temperature fluctuation imparting surface to the inlet of the fluid agitation apparatus is 1,000 mm. In the both examples, the distance from the outlet of the fluid agitation apparatus to the right end surface of FIGS. 4 and 5 serving as the temperature fluctuation evaluation surface is 1,000 mm.

Further, regarding the status of the temperature fluctuation imparted as an initial condition of the numerical analysis, a temperature difference of 10° C. at maximum is imparted at the temperature fluctuation imparting surface, which is common between the both examples.

In the fluid agitation apparatus according to the example of the present invention illustrated in FIG. 4, the length of the dividing part, the circumvolving part, and the accelerating part is 100 mm in total, and the length of the part which is continuous with the downstream side of the accelerating part and has a gradually increasing sectional area of the fluid passage is 400 mm. Therefore, the total length of the fluid agitation apparatus is 500 mm. In the conventional fluid agitation apparatus illustrated in FIG. 5, it is assumed that the length of one fluid agitation apparatus illustrated in FIG. 3 is 300 mm and two sets of fluid agitation apparatus having opposite revolving directions are used alternately. Therefore, the total length of the fluid agitation apparatus is 1,200 mm.

Besides the above-mentioned conditions, the types of fluid and the like were changed so that the numerical analysis was conducted under a plurality of conditions. Table 1 shows the conditions and results of the numerical analysis in combination.

TABLE 1

| Item | Condition 1 | Condition 2 | Condition 3 | Condition 4 |
|---|---|---|---|---|
| Type of fluid agitation apparatus | Example of present invention | Conventional Example | Example of present invention | Conventional Example |
| Type of fluid | Air | | Water | |
| Flow rate | 20 $m^3$/min | | 30 L/sec | |
| Analysis result: Standard deviation of temperature fluctuation at evaluation surface | 0.100° C. | 0.124° C. | 0.100° C. | 0.257° C. |

As can be seen from the results of the numerical analysis shown in Table 1, the fluid agitation apparatus according to the example of the present invention exhibits a higher degree in the effect of reducing temperature fluctuation of both air and water as compared to the example of the conventional fluid agitation apparatus. Further, as described above, the overall length of the fluid agitation apparatus according to the example of the present invention is 500 mm, whereas the overall length of the fluid agitation apparatus according to the conventional example is 1,200 mm. It can be said from the above that the fluid agitation apparatus according to the example of the present invention is simpler in shape and short in the fluid passage direction, and exhibits a higher degree in the effect of reducing temperature fluctuation of both air and water as compared to the example of the conventional fluid agitation apparatus.

(Second Embodiment)

Figure 2A:
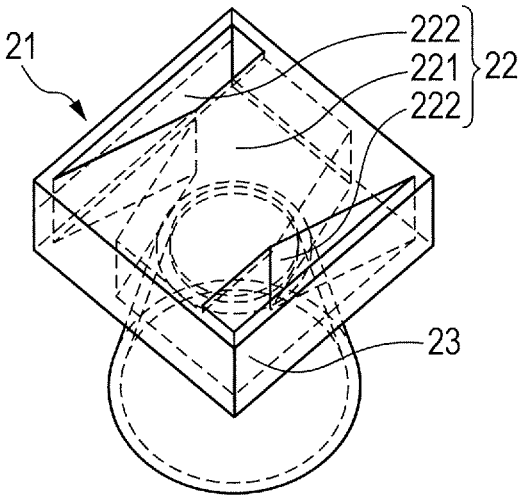
FIGS. 2A, 2B, 2C, and 2D are views illustrating a fluid agitation apparatus according to a second embodiment of the present invention. Specifically.
Figure 2B:
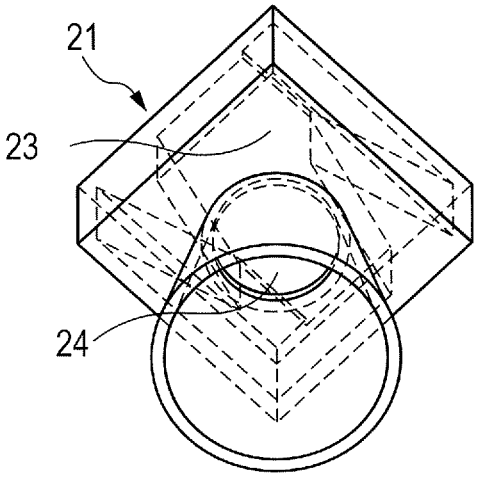
Figure 2C:
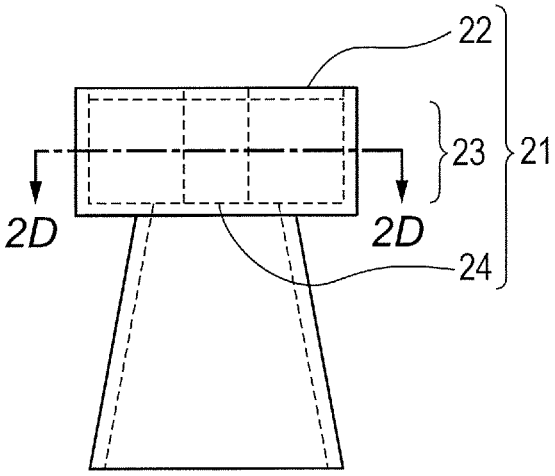
Figure 2D:
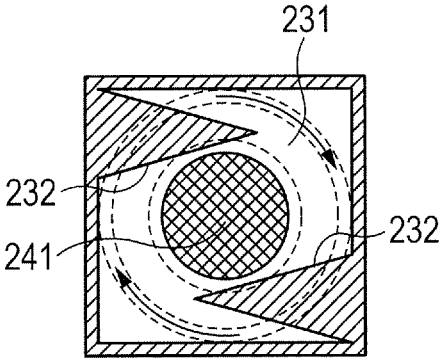

FIGS. 2A, 2B, 2C, and 2D are views illustrating a fluid agitation apparatus according to a second embodiment of the present invention. Specifically, FIG. 2A is a perspective view of the fluid agitation apparatus as seen from the upstream side of the fluid passage. FIG. 2B is a perspective view of the fluid agitation apparatus as seen from the downstream side of the fluid passage. FIG. 2C is a side view of the fluid agitation apparatus. FIG. 2D is a sectional view taken along the line 2D-2D of FIG. 2C. Incidentally, the broken lines of FIGS. 2A, 2B, 2C, and 2D are hidden lines, and the portion indicated by hatched lines in the sectional view shows a cross section, while the portion indicated by cross-hatched lines shows the shape of an opening plane of the accelerating part. As is apparent from FIGS. 2A, 2B, 2C, and 2D, the fluid agitation apparatus of this embodiment is also formed into a simple shape including a flat surface, a cylindrical surface, a tapered surface, and the like.

A fluid agitation apparatus 21 for reducing temperature fluctuation according to the second embodiment is different from the fluid agitation apparatus 11 for reducing temperature fluctuation according to the first embodiment in that a circumvolving part 23 has a rectangular outline. Along with this, the shapes of a dividing part 22 (opening planes 222 have a polygonal shape) and stationary surfaces 232 (wedge shape) are different from those of the first embodiment. However, the functions attained by the dividing part 22, the circumvolving part 23, and an accelerating part 24 are the same as those of the corresponding components of the first embodiment. When the main part of the fluid passage is desired to have a rectangular shape in cross section from the viewpoint of installation, the fluid agitation apparatus is formed into the shape as described in this embodiment, with the result that the same performance as that of the fluid agitation apparatus of the first embodiment can be obtained.

The functions of the respective components of the fluid agitation apparatus 21 according to the second embodiment are the same as those of the corresponding components of the first embodiment, and detailed description thereof is therefore omitted herein.

Incidentally, there have herein been described only two embodiments in which the fluid agitation apparatus has a circular or rectangular outline, but the fluid agitation apparatus may have a triangular, pentagonal, or other polygonal outline, and may have a shape obtained by combining curved lines and straight lines instead. Further, there has only been described that the dividing part divides the flow of the fluid into two flows, but the dividing part may divide the flow of the fluid into three or more flows.

(Third Embodiment)

Figure 6:
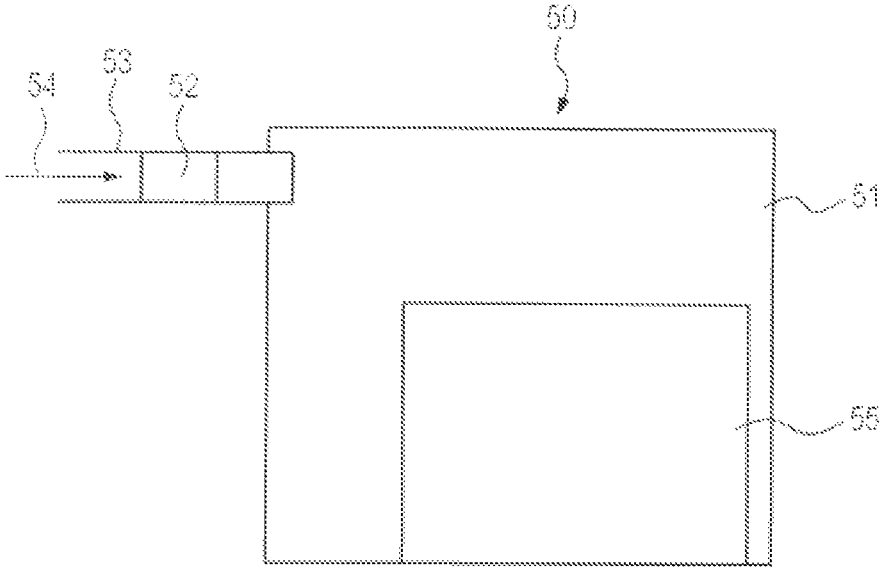
FIG. 6 is a view illustrating a thermostatic apparatus according to a third embodiment of the present invention.

FIG. 6 is an explanatory view illustrating a thermostatic apparatus 50 according to a third embodiment of the present invention. In FIG. 6, the thermostatic apparatus 50 includes a thermostatic chamber 51, in which an apparatus 55 such as a semiconductor exposure apparatus or an ultra-precision machining apparatus required to have high processing accuracy is installed. A fluid 54 is introduced into the thermostatic chamber 51 through a fluid passage 53 so as to maintain the temperature in the thermostatic chamber at a constant temperature. FIG. 6 illustrates an example in which a gas is introduced, but the fluid 54 may be a gas such as air or a liquid such as water. A fluid agitation apparatus 52 corresponding to the fluid agitation apparatus according to the first embodiment or the fluid agitation apparatus according to the second embodiment is installed in the fluid passage 53 so as to agitate the fluid 54. Accordingly, the temperature fluctuation in the thermostatic chamber can be suppressed, and therefore the positioning and processing accuracy of the apparatus 55 such as a semiconductor exposure apparatus or an ultra-precision machining apparatus installed in the thermostatic chamber 51 can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-267064, filed Dec. 6, 2011 which is hereby incorporated by reference herein in its entirety.

What is claimed is:

1. A fluid agitation apparatus for reducing temperature fluctuation, which is installed in a fluid passage, the fluid agitation apparatus comprising:

a dividing part for dividing a flow of the fluid into a plurality of flows by means of a plurality of opening planes formed by closing a central portion of the fluid passage with a first closing surface;

a circumvolving part connected to a downstream side of the dividing part, for circumvolving the fluid about an axis in a flow direction of the fluid, in which a second closing surface is disposed in a direction perpendicular to the fluid passage direction with only a central part of the fluid passage being opened, a rectangular plate is disposed in a direction parallel to the fluid passage direction, and only one end of the rectangular plate is in contact with an inner wall surface of the circumvolving part; and an accelerating part connected to a downstream side of the circumvolving part and connected to the opening formed only at the central part of the fluid passage of the circumvolving part, for increasing a flow rate of the fluid.

2. A thermostatic apparatus, comprising the fluid agitation apparatus for reducing temperature fluctuation according to claim 1.

3. The fluid agitation apparatus for reducing temperature fluctuation according to claim 1, wherein the accelerating part has a cross section of a circular shape.

4. The fluid agitation apparatus for reducing temperature fluctuation according to claim 1, wherein the circumvolving part has a cross section of a circular shape.

5. The fluid agitation apparatus for reducing temperature fluctuation according to claim 1, wherein the circumvolving part has a cross section of a polygonal circular shape.

* * * * *